United States Patent [19]

Sansone et al.

[11] Patent Number: 4,673,303

[45] Date of Patent: Jun. 16, 1987

[54] OFFSET INK JET POSTAGE PRINTING

[75] Inventors: Ronald P. Sansone, Weston; Antonio S. Cruz-Uribe, Cobalt; Mike S. H. Chang, Danbury, all of Conn.

[73] Assignee: Pitney Bowes Inc., Stamford, Conn.

[21] Appl. No.: 784,907

[22] Filed: Oct. 7, 1985

[51] Int. Cl.[4] ..... B41J 3/02; B41J 29/40; B41J 29/26

[52] U.S. Cl. ..... 400/126; 400/82; 400/54; 400/695; 101/91; 101/425; 101/426

[58] Field of Search ..... 355/14 D, 14 R, 14 TR; 101/425, 426, 1, 91; 346/140 IJ, 21; 400/126, 82, 695, 54

[56] References Cited

U.S. PATENT DOCUMENTS

| | | | |
|---|---|---|---|
| 2,735,364 | 2/1956 | Muller | 101/142 |
| 3,460,143 | 8/1969 | Vaccaro | 101/1 |
| 4,095,890 | 6/1978 | Van Herten | 355/14 R |
| 4,328,504 | 5/1982 | Weber et al. | 346/140 IJ |
| 4,340,893 | 7/1982 | Ort | 400/126 |
| 4,396,276 | 8/1983 | Murasaki | 355/14 D |
| 4,536,082 | 8/1985 | Motohashi | 355/14 TR |
| 4,536,156 | 8/1985 | Durkee et al. | 346/21 |

FOREIGN PATENT DOCUMENTS

| | | | |
|---|---|---|---|
| 655200 | 1/1938 | Fed. Rep. of Germany | 101/201 |

*Primary Examiner*—William Pieprz

*Attorney, Agent, or Firm*—Peter Vrahotes; Melvin J. Scolnick; David E. Pitchenik

[57] ABSTRACT

A postage meter utilizing an offset printing roll. A die plate carried by the roll has a first region for receiving thereon fixed information such as the city and state, and a second region for receiving thereon variable information such as the date and postage amount. At the beginning of a revolution of the printing roll, the second region is depressed and an inking roll applies ink to the first region. Then the second region is moved into the plane of the first region and an ink jet printing device projects ink droplets onto the second region to form the variable information thereon. The quality of the printed form of the variable information is sensed. If acceptable, a document is printed. If unacceptable, the first and second regions are both wiped clean and the entire operation is repeated. The cleaning operation can employ an hydrophilic oil which is applied to the printing roll. Furthermore, apparatus can be employed to improve the characteristics of the ink after it has been applied to the printing roll but before it reaches the document to be printed.

25 Claims, 5 Drawing Figures

OFFSET INK JET POSTAGE PRINTING

FIELD OF THE INVENTION

This invention relates to postage meters which utilize an electronically controlled ink jet printing device, and, more particularly, to such apparatus in which the ink jet printing device applies the variable information portion of the postage indicia.

BACKGROUND OF THE INVENTION

Postage meters are well-known in the art and commonly include selectively operable alpha-numeric printing means for printing postal indicia on envelopes or the like. Typically two types of printing means are employed: one being a die plate that is adapted to print fixed information such as the town and state, while the other is a settable printing means which is adapted to print variable information such as date and postage amount. The variable printing means usually includes print wheels which project through suitable apertures formed in a curved die plate carried on the periphery of a drum. When the drum is rotated the printing die plate and the print wheels are suitably inked so as to be capable of imprinting on an envelope a composite postage marking.

In order to vary the postage amount and the date, a keyboard or similar setting means is normally provided to selectively vary the operative positions of the print wheels which are mounted to bodily rotate with the said drum. The setting linkage between the print wheels and the keyboard necessitates a rather intricate and mechanically complex arrangement to enable the print wheels to be first variably set to selected rotary positions from the keyboard and then be bodily swung through a rotary printing path determined by the movement of the printing drum.

In an improved postage meter of known design, as disclosed in commonly assigned U.S. Pat. No. 3,869,986 to Hubbard, the variable printing wheels and the associated setting linkages are dispensed with and replaced with an electronically controlled and actuated ink jet printing device. A drum carries an apertured printing die plate that is adapted to cooperate with a stationary ink jet printing device to produce a postage imprint. When a date aperture and a postage amount aperture in the die plate pass below the ink jet printing device, a plurality of ink droplets are sequentially ejected through the apertures and onto an envelope or label located at the meter print station. An electronic control is provided to actuate the ink jet printing device in timed relation to the movement of the die plate to form the required number and placement of the ink dots on the envelope to thereby establish the desired date and/or postage amount indicia. A drum position sensor is used to determine when the die plate apertures are properly aligned with the ink jet printing device and the postage receiving portion of an envelope or label. A print signal is then generated by the sensor and applied to the electronic control to initiate and sequence the ejection of the ink droplets.

By so incorporating a jet printing device in the postage meter the structural arrangement of the meter has been greatly simplified, and the mechanical complexity reduced to the point that a relatively simple efficient electronically controlled postage printing machine has been made possible.

The improved meter just described employs the die plate on the offset drum to provide the fixed information for subsequent application to the envelope or label while the ink jet printing device is used to print directly onto the envelope or paper. A fundamental problem in ink jet technology, however, has been in the ink/paper interaction. Since the ink wicks into the paper, much of the dye is drawn below the paper surface and hence does not contribute to the optical density. Also, the wicking is influenced by the paper's irregular surface resulting in non-uniform spreading and irregular edges. Another major problem with the patented concept has been the inability to make necessary corrections to the variable information prior to its application to the envelope or label.

In the past, various mechanisms have been devised for cleaning rolls or drums prior to the printing operation. Typical of such mechanisms are the disclosures in U.S. Pat. Nos., respectively, 4,135,448 to Moestue, 4,162,652 to Rebel et al, 4,236,450 to Bonomi, 4,311,095 to Jeschke, and 4,449,241 to Nakayama. Furthermore, U.S. Pat. No. 2,780,168 to Nichols discloses a specific liquid composition which can be applied to an offset printing mat to eliminate oil and grease smudges prior to the printing operation.

SUMMARY OF THE INVENTION

It was with knowledge of the drawbacks or problems just noted, and others, that the present invention was conceived and has now been reduced to practice. According to the invention, a postage meter utilizes an offset printing roll. A die plate carried by the roll has a first region for receiving thereon fixed information such as the city and state, and a second region for receiving thereon variable information such as the date and postage amount. At the beginning of a revolution of the printing roll, the second region is depressed and an inking roll applies ink to the first region. Then the second region is moved into the plane of the first region and an ink jet printing device projects ink droplets onto the second region to form the variable information thereon. The quality of the printed form of the variable information is sensed. If acceptable, a document is printed. If unacceptable, the first and second regions are both wiped clean and the entire operation is repeated.

A primary advantage of the present invention is that the process represents an improvement in the ink/paper interaction. In accordance with the invention, the ink can be modified on the secondary or intermediate surface of the drum so that it can be transferred to the final surface (the paper) thereby achieving the primary advantages of offset printing which includes sharp edge definition, high optical density, and the minimum of irregular character edges. The modification can be accomplished by electromagnetic radiation (visible or ultraviolet), heat, or addition of a catalyst. In this fashion, the ink can be cured to increase the viscosity by an order of magnitude. This diminishes lateral wicking, that is, the problem of ink following fibers to form narrow filament in the paper, and results in a sharper, better defined image.

The invention also manifests other very significant advantages and features. For example, a controlled and isolated compartment can be used for the ink jets to prevent airborne contamination, such as that emanating from the paper or from the general atmosphere. This eliminates problems encountered in dusty environments where particulates gather at the nozzles blocking or misdirecting the ink stream. Also, the concept enables the ink jets to be moved closer to the print surface or drum which thereby improves the drop placement accuracy of the ink jet device. Also, since the ink used does not dry immediately upon exposure to air, there is sufficient time to step over the ink jet head so that it can print between the previously printed drops. This interlacing enables higher resolution. Interlacing could also be achieved by a second print head. The concept also enables application of the electrostatic pull technique to apply drops to the intermediate surface. Since there is no intervening paper, the sharp points can be moved closer, thereby achieving higher resolution with the use of lower voltages. A particularly significant feature is that the actual printed message on the drum can be verified by scanning it electronically. If droplets are missing or of poor quality, the drum can be erased and the printing operation repeated. This feature is especially important in a postage meter since the user's account is not changed until there has been verification that an acceptable image has acctually printed.

BRIEF DESCRIPTION OF THE DRAWINGS

These and other features and advantages of the instant improved postage printing device may be understood from the following description of a preferred embodiment as illustrated in connection with the drawings wherein.

DETAILED DESCRIPTION OF THE PREFERRED EMBODIMENT

Except as otherwise provided herein, the instant postage meter apparatus may be constructed and arranged in a manner similar to that of presently known postage meters and associated apparatus. The following description is general in nature as respects the meter controls in that such are significant only to the extent that they illustrate the cooperation between the instant jet printers with the remaining printing means of the instant meter.

Figure 1:
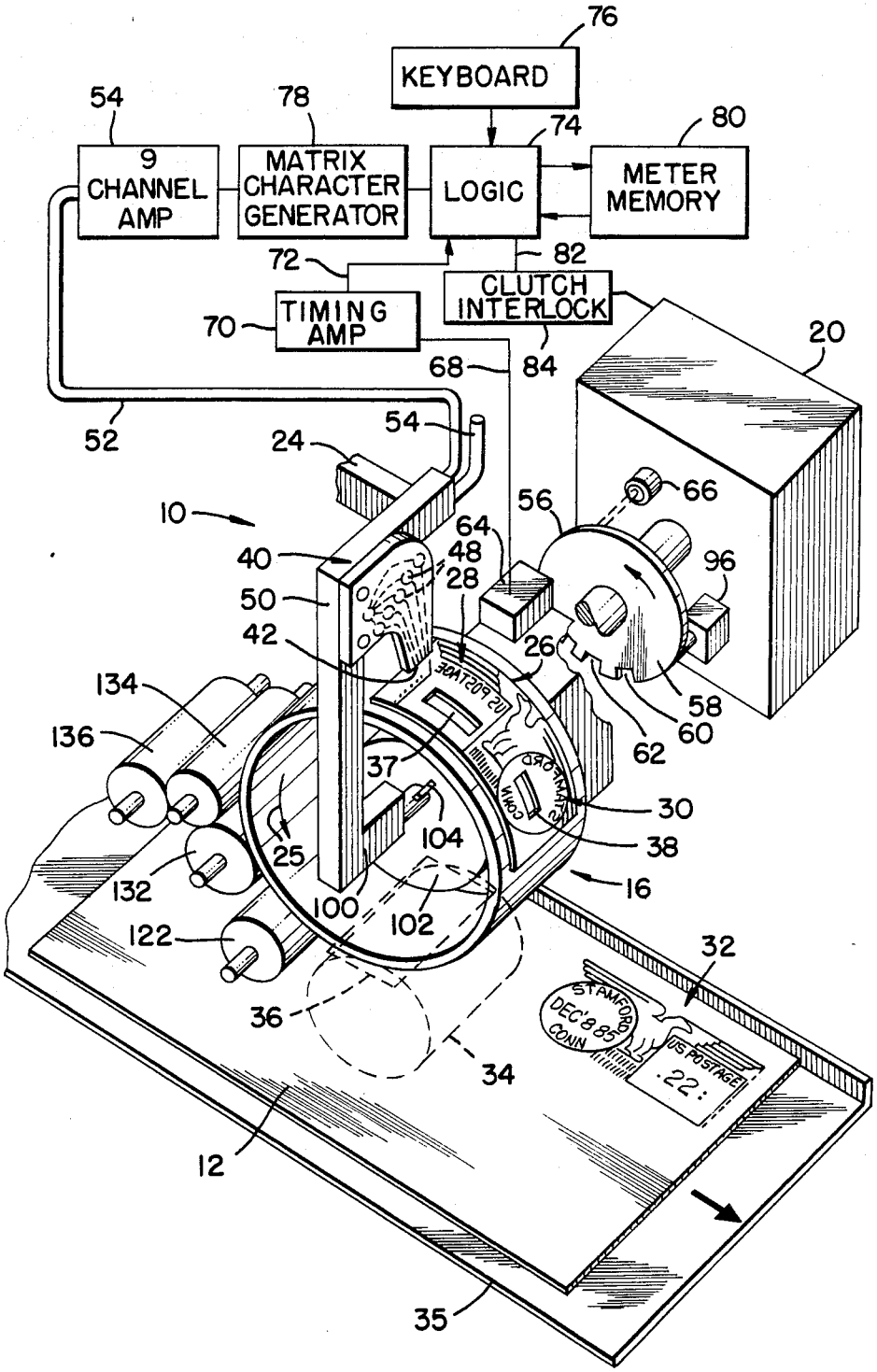
FIG. 1 is a perspective partially schematic representation of a pertinent portion of a postage printing device with its ink printing means and controls arranged in accordance with the invention.
Figure 2:
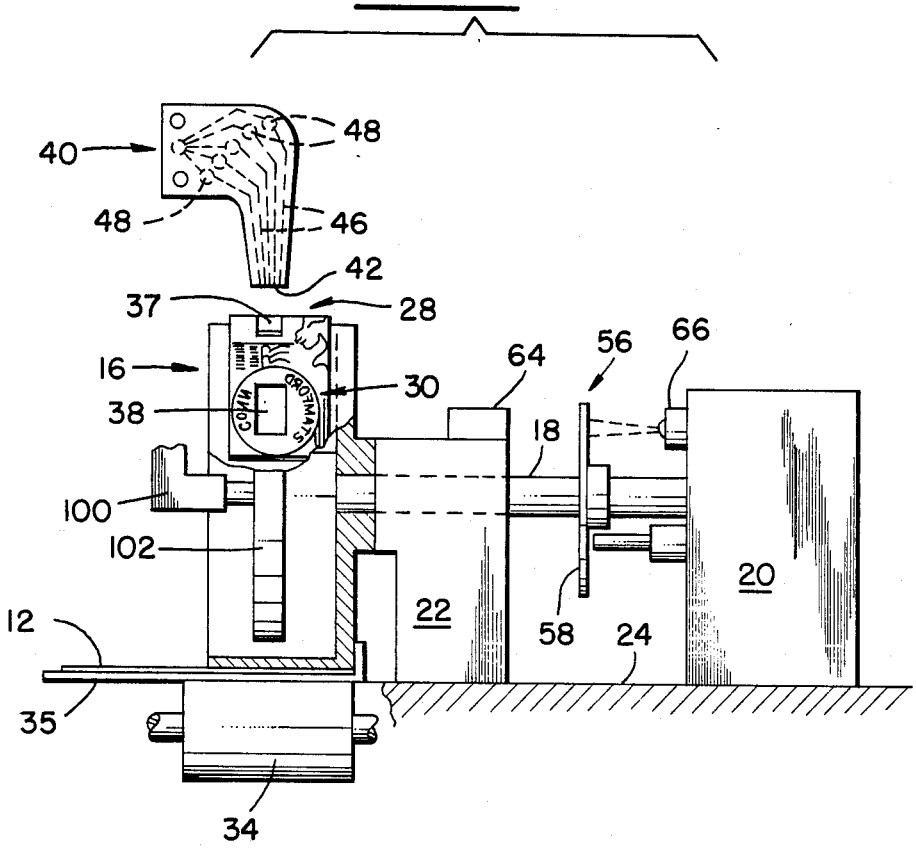
FIG. 2 is a side elevational view in partial section and illustrates the arrangement of the postage printing device shown in FIG. 1.

With reference to FIGS. 1 and 2, some of the components of an improved postage meter 10 constructed in accordance with the invention are shown with an envelope 12 being illustrated in transit through a print station. A printing drum 16 is secured to a shaft 18 (see FIG. 2) that is adapted to be rotatably driven by a motor 20. Shaft 18 is journaled in a suitable bearing 22, FIG. 2, mounted on a machine frame 24 and is adapted to rotate drum 16 in the direction shown by an arrow 25, FIG. 1. Drum 16 carries an arcuate die printing plate 26 which is provided with printing elements such as 28, 30 that are operative to print the fixed or non-varying postal indicia illustrated in a postage marked region 32 of envelope 12, FIG. 1. A spring biased swingable impression roller 34 supported in a conventional manner on the machine frame is located below the lower peripheral portion of drum 16 to assure operative contact of the envelope with the drum 16 as the latter rotates in printing contact with the envelope 12. Envelope 12 is slidably supported on an envelope support plate 35 having a suitable opening 36, FIG. 1, that enables the impression roller 34 to contact the envelope 12.

The printing die plate 26 has a pair of circumferentially spaced segment plates 37, 38 that are adapted to receive thereon variable information to complete the postage marked region 32 of the envelope 12. Specifically, the segments 37 and 38 are positioned to permit a stationary ink jet printing device 40 to project ink droplets onto the surfaces of the segments 37 and 38. The leading segment plate 37 serves to receive thereon the postage amount forming ink droplets from the device 40 while the trailing segment plate 38 serves to receive the date forming droplets from the device 40. The ink jet printing device 40 is illustrated as being positioned above the drum 16 in FIG. 1. Although not illustrated, the concept of the invention readily permits the enclosure of the device 40 to assure that the ink droplets will be deposited on the segment plates 37 and 38 without contamination from the surrounding environment. The ink jet printing device is preferably stationary, being mounted on a suitable supporting member of the machine frame 24 so as to enable the segment plates 37 and 38 to pass adjacent the lower ink nozzle end 42 thereof.

Figure 3:
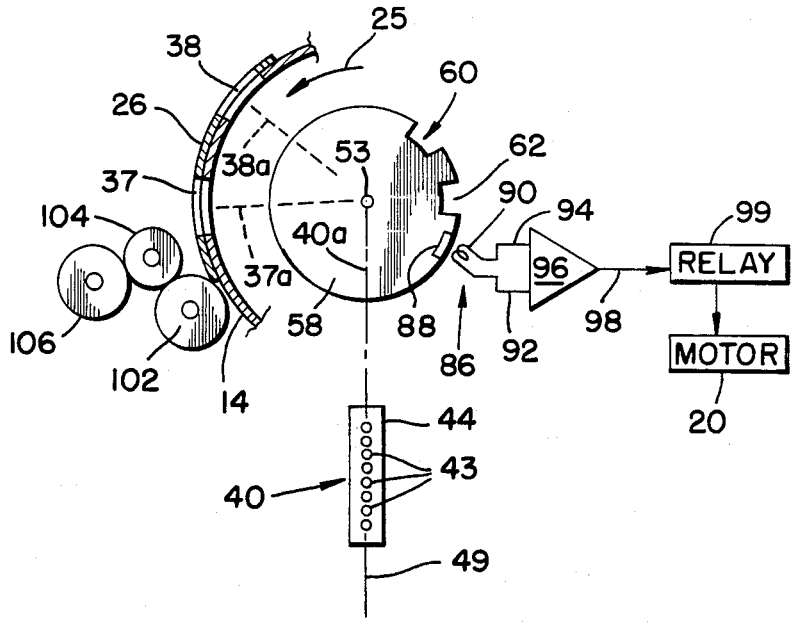
FIG. 3 is a schematic representation of the control elements employed with the postage printing device in accordance with the instant invention.

The ink jet printing device 40 is formed with a plurality of precisely aligned and closely spaced ink-conducting capillaries or channels 46 whose respective ends 44 (FIG. 3) are arranged in a linear array at said lower end 42 of the printer as is illustrated in FIGS. 2 and 3. The capillaries are selectively actuated to generate the proper number and sequence of ink droplets to form the alpha-numeric postage characters on the envelope. The general construction and operation of this type of ink jet printing device may be similar to that presently produced and sold by Gould, Inc. of Chicago, IL and hence such needs no detailed description here. Suffice it to indicate that a piezo-electric crystal 48 is located in communication with each of the capillary channels 46. When a crystal is energized by an electrical pulse, a slight physical deflection thereof is produced which is sufficient to cause ejection of tiny ink drops through the end 43 of the associated channel 46. These piezo-electric crystals 48 may be located on both sides of the ink jet printing element 40 so that the ends 43 of said channels 46 may be closely spaced along a channel end center line 49, FIG. 3.

The ink jet printing device 40 is mounted on the machine frame by means of a bracket 50, FIG. 1, which carries suitable electrical control leads 52 to the individual piezo-electric elements 48. In FIGS. 1 and 2, five crystals 48 are shown mounted on the visible side of jet printing device 40 with four others (not shown) being mounted on the other side thereof. An ink supply tube 54, FIG. 1, is supported by bracket 50 and is in ink-supplying communication with the ink capillaries 46. The ink jet printing device 40 is disposed such that the ink droplets ejected from the channel ends 43 are projected radially towards a rotational axis 53 of drum 16 and downwardly towards the drum 16 along a vertical plane which includes the drum axis 53 and the center line 49. Although the plane of the end 44 of the jet printing device 40 is actually substantially normal to the plane of drum 16 as shown in FIG. 1, the plane of the end 44 of the printing device is, for ease of description, shown in FIG. 3 as being substantially parallel with the plane of the drum 16.

The rotation of shaft 18 is sensed by operation of a drum position sensor 56 that causes the ink jet printing device to be actuated in timed relation to the rotation of the print drum 16. Although an optical type position sensor is illustrated here, it will be apparent that other conventional types of rotational position sensing means such as magnetic devices, etc. may be alternately used. The sensor 56 includes a timing disc 58 that is secured to shaft 18, the disc being provided with a pair of rotational position indicating apertures or slots 60, 62. Sensor 56 also includes a conventional type photo detector 64 which is operatively aligned with a light source 66. As will be apparent a signal will be generated at the sensor output line 68 when each disc slot 60, 62 swings between the source 66 and the detector 64. The peripheral locations of the slots are arranged so that the output signals at line 68 occur when the segment plates 37, 38 respectively move below the lower end 44 of the ink jet printing device 40.

Any suitable electrical control means may be used to produce the synchronization between rotation of the print drum 16 and the sequence pulse actuation of the jet printer 40. An exemplary type of control is generally illustrated in FIG. 1 wherein the output print signal on line 68 is applied to a timing amplifier 70 whose output line 72 drives a logic network 74. The latter network enables preset keyboard 76 signals to be applied to a matrix character generator network 78 and a meter memory 80. The output from the actuation of a keyboard and/or other setting means for producing variable date and postage amount information is permitted to pass by logic network 74 to the matrix 78. The latter then generates a proper conversion of the keyboard data to a coding compatible with the nine ink-dot producing channels 46. Thus, matrix 78 determines both which piezo-electric crystals are to be activated as well as the sequencing actuations thereof needed to produce the keyboard set postage characters. When the logic network 74 is activated by a print signal on line 72, the keyboard data is stored in permanent meter memory 80. In addition, an interlock signal is produced on line 82 to a clutch interlock 84 coupled to motor 20. The clutch interlock assures that the machine printing cycle will be completed once it has been initiated. Timing disc 58 further is associated with a suitable cycle terminating device 86, FIG. 3, which is coupled to motor 20 so as to terminate the rotation of drum 16 at a desired home position. The cycle terminating device 86 includes a magnetic flux element 88 mounted on the perimeter of the timing disc 58 and a magnetic sensor 90 which is closely spaced from the timing disc 58 and which is adapted to thereby sense the passage of the flux element 88. The position of sensor 90 is so chosen that when it senses the passage of flux element 88, the first segment plate 37 is located approximately at a home position indicated in FIG. 3 by the line 37*a*, the then relative operative position of the jet postage printing device 40 here being indicated by line 40*a* in FIG. 3. When sensor 90 has detected the passage of flux element 88, a signal is applied on lines 92, 94 to an amplifier 96 whose output 98 is coupled to a suitable electromagnetic relay 99 to terminate the rotational drive from motor 20.

Turn once again to FIGS. 1 and 2. The lowermost extremity of the bracket 50 terminates at a laterally extending arm 100 which is coaxially positioned with respect to the axis 53 of the drum 16. A cam 102 is fixed on the arm 100 and positioned internally of the drum 16. A key 104 is received in suitable slots within the arm 100 and cam 102 to hold the cam fixed against rotation relative to the arm 100.

Figure 4:
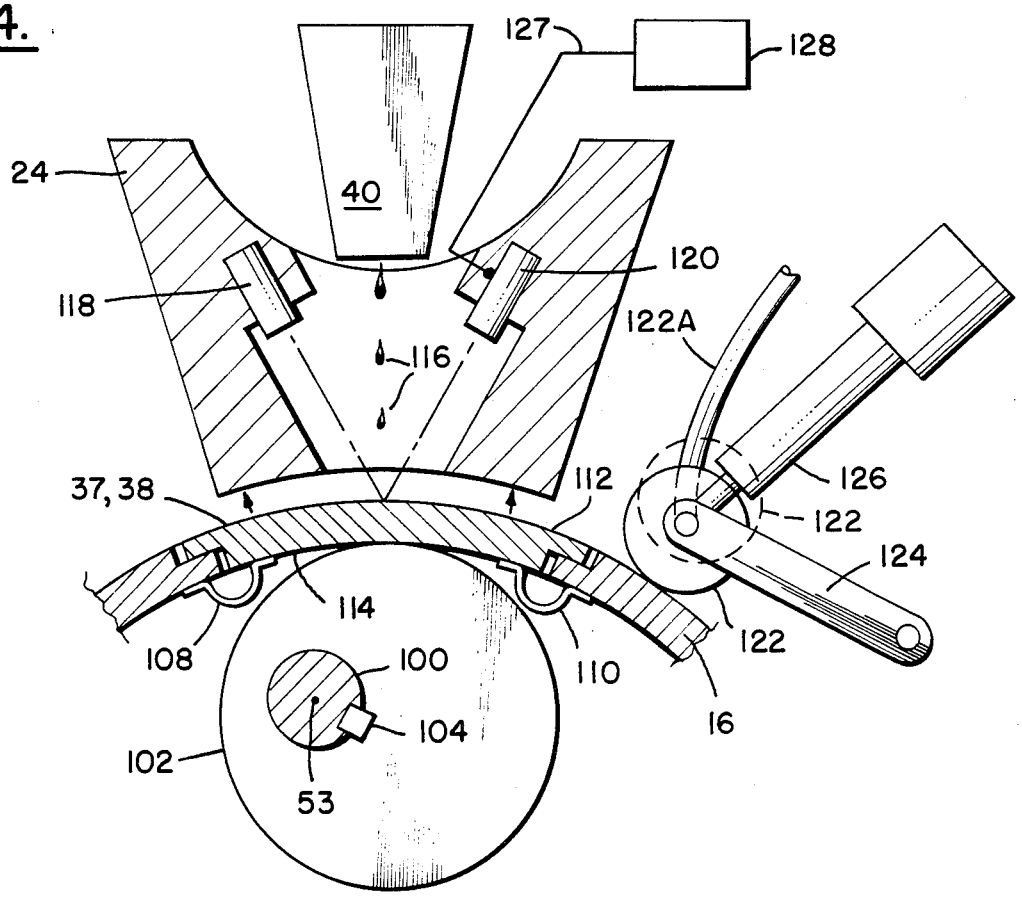
FIG. 4 is a detail end elevational view of the postage printing device illustrated in FIG. 1, certain parts being cut away and in section.
Figure 5:
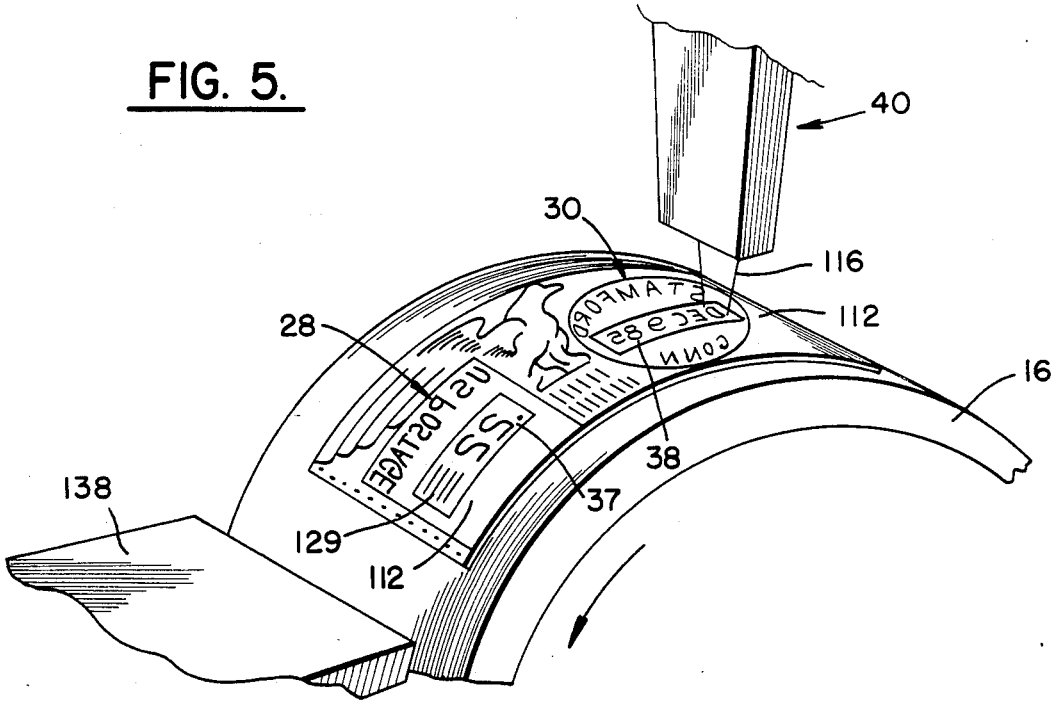
FIG. 5 is a detail perspective view of the ink jet print device forming the variable information of the postage indicia according to the invention.

As best seen in FIGS. 4 and 5, each of the segment plates 37 and 38 is loosely received in a stepped aperture 106 of similar shape thereto. Viewing especially FIG. 4, suitable springs 110 serve to connect the segment plates 37 and 38 at their opposite ends to the drum 16 and serve to bias the segment plates to a withdrawn position such that an ink receiving surface 112 lies beneath the cylindrical plane of the outer surface of the drum 16. When the segment plates 37 and 38 are engaged on their rear surfaces 114 by the cam 102 upon rotation of the drum 16, they are moved radially outwardly against the bias of the springs 110 so that the ink receiving surface 112 extends radially beyond the usual surface of the drum 16, but generally coplanar with the raised portions of the printing plate 26 which create the fixed information of the postage marked region 32.

Turning once again to FIGS. 4 and 5, the ink jet printing device 40 is illustrated ejecting droplets 116 towards the ink receiving surface 112 of one of the segment plates 37 or 38. Mounted to the frame 24 is a sensor mechanism composed of a light source 118 and a detector 120, both of which are indicated as being directed toward the ink receiving surface 112 as it receives the droplets 116. The sensor arrangement may be of any suitable type adequate to determine whether or not the clarity of the variable information being placed on the ink receiving surface 112 is acceptable.

A wiper pad 122 may be in the form of a roll mounted on an axis generally parallel to the axis 53 and on a pivot arm 124 enabling its movement between an active position indicated in solid lines and a retracted position indicated in dotted lines (Fig. 4). An actuator 126 of any suitable type is effective to move the wiper pad between the active and retracted positions. When the wiper pad 122 is in the active or solid line position (FIG. 4), it is effective to wipe clean the ink receiving surfaces 112 of the segment plates 37 and 38 as well as the printing elements 28 and 30 of the printing plate 26. The roll embodying the pad 122 may be so mounted that it is normally restrained against rotation on its axis, but can be rotated manually, or in some other fashion, so as to even the wear caused to the outer surface thereof.

In the event the detector 120 determines that the quality of the variable information applied to the receiving surface 112 is unacceptable, the actuator 126 is energized to move the wiper pad 122 to the solid line position and into engagement with the printing elements 28 and 30 and the segments plates 37 and 38 to remove all the ink thereon prior to engagement of the roll with the envelope 12 or other item on which postage indicia is to be printed. Conversely, in the event the detector 120 determines that the quality of the variable information applied to the receiving surface 112 is acceptable, a signal is forwarded via a line 127 to a suitable accounting mechanism 128 (FIG. 4) which may be of conventional design. The accounting mechanism 128 operates to charge or debit the user's account in an amount equal to the value of the postage to be applied to the envelope 12. In this fashion the postage meter 10 only charges a user for the amount of postage actually used and not for indicia printed on the segments 37, 38 subsequently determined to be unacceptable.

It has also been found desirable to apply in some suitable fashion, as diagrammatically represented in FIG. 4 an hydrophilic oil to the outer peripheral surface of the wiper pad 122. Thus, a tube 122A extending from a source (not shown) of hydrophilic oil to the interior of the hollow wiper pad. Thereupon, the hydrophilic oil is caused to penetrate to the surface of the wiper pad. This is for application, in turn to the drum 16 when the wiper pad is engaged with the drum. This serves to eliminate the image "scattering" problem which is associated with unoiled wipers often used in the operation of offset ink jet printers. Image "scattering" results when the images on the printing elements 28,30 of the drum 16 are not accurately transferred to a receiving surface such as the envelope 12 but instead are broken up or scattered during the transfer process.

The lubricating action of hydrophilic oils including glycerine, glycol, polyethylene glycol, starch, and hydroxy methyl cellulose as applied by the wiper pad 122 have provided excellent results. That is, after the wiper pad has imparted a film of hydrophilic oil to the surface of the drum 16, excellent images can thereafter be transferred from the drum to the receiving surface. Of course, it will be appreciated that since starch and hydroxy methyl cellulose are solids, they would have to be mixed with a solvent such as glycerine, glycol, or polyethylene glycol before being used with the wiper pad 122.

As illustrated in FIG. 5, the ink jet printing device 40 can be suitably programmed to apply a coded indicia 129 to the ink receiving surface 112 of the segment 37. Of course, such indicia could also be applied, if desired, to the segment 38. In any event, the coded indicia 129, which could be coded by color, or by dots and lines, or by alpha-numeric symbols, or in some other fashion, could serve to guard against counterfeiting or simply be used for record keeping purposes. Such indicia could be altered periodically as a further protection in the event it is used for purposes of security.

Although not illustrated, it might be desirable to incorporate another wiper pad into the postage meter 10 effective to wipe the printing elements 28, 30, but more particularly the surfaces 112 of the segment plates 37 and 38. Thus, the machine can readily accommodate changes in the date and/or amount of postage to be applied to the marked region 32. In this fashion, all ink receiving surfaces are wiped completely clean in readiness for the application of new variable information by the ink jet printing device 40.

The operation of the postage meter 10 is commenced after the envelope 12 is inserted from the left, as seen in FIG. 1, to a position such that its leading edge 130 is initially located approximately in the plane of centers of drum 16 and the impression roll 34. The keyboard and/or other setting control means for the variable amount and data date to be printed is then operated and the usual machine, trip or cycle initiating means (not shown) is actuated to initiate operation of motor 20. The drum 16 being thus driven, the die printing plate 26 is initially brought into contact with a suitable inking roller 132, the latter being provided in the usual manner with ink from transfer rollers 134 and 136 which are coupled to an ink supply (not shown). At this station in the course of a revolution of the drum 16, the cam 102 has a flattened periphery permitting the segment plates 37 and 38 to move to their withdrawn position under bias of the springs 108 and 110 so as not to come into engagement with the roller 132.

When the die plate 26 thereafter contacts envelope 12, the latter will be gripped between the radially extended peripheral portion of the plate 26 and the cooperating impression roll 34 so as to be longitudinally fed to the right, as seen in FIG. 1, as the drum 16 is driven in a counter-clockwise direction as indicated by arrow 25 of FIG. 1. During this longitudinal movement of the envelope, the inked printing die plate will progressively roll print the fixed postal indicia 28, 30 etc. onto the envelope. At the same time, the variable postage amount and date indicia previously applied to the segment plates 37 and 38 by the jet printer 40 will also be printed onto the envelope as the segment plates 37 and 38 respectively swing past the print station whereby a complete composite postal marking is thereby produced on the envelope 12, the timing for printing of these variable indicia being under the control of disc sensor 56.

When the first segment plate 37 arrives in alignment with the ink jet printing element 40, a print signal from sensor 56 (corresponding to disc notch 60) is produced on line 68. This results in the operation of the jet printer to print the postal amount that has been set on the keyboard or other input control. When the next segment plate 38 thereafter arrives at the ink jet printing device 40, another print signal is produced by sensor 56 (corresponding to disc notch 62) and this print signal causes the matrix 78 to control the pulse actuation of the jet printer so that the date indicia is printed on the envelope. After the completion of the postage printing action during one revolution of the drum 16, the machine cycle is terminated by action of the terminating device 86 so that the segment plate 37 is again in its home position 37*a*. Of course, as previously explained, if the indicia printed on the segments 37, 38 is not acceptable, the indicia is removed and the user's account is not charged until it is subsequently printed in an acceptable fashion.

It might also be desirable to modify the characteristics of the ink after it has been applied to the surface 112. For example, it might be desirable to increase the viscosity of the ink to thereby obtain sharper, better defined images. A suitable element 138 is diagrammatically illustrated in FIG. 5 to direct appropriate rays or fluid material toward the surface of the drum 16. Thus, the element 138 can be of any appropriate construction such as a nozzle to direct a fluid catalyst against the inked surface, or a lamp to direct electromagnetic radiation (visible or ultraviolet) against the inked surface, or a heat transfer device such as a nozzle connected to a heated duct for warming the surface of the drum.

The above described postage meter arrangement being essentially electrically controlled as respects printing of the variable indicia allows the many complex mechanical linkages normally associated with postage meters to be eliminated. Also, this arrangement allows the meter to be coupled to and/or incorporated in various types of electrical control devices or systems. The embodiment described above illustrates the formation of a postage marking using both a conventional die plate and the ink jet printing device. However, the ink jet printing device may be used to form the entire postage marking. As will be evident, the postage indicia may be printed on a label instead of on an envelope, the printed label then being secured to a package or other item to be mailed.

For the purpose of clarity, many of the conventional mechanical safety and security features normally included in postage meters are not described herein. However, these form no part of the instant invention and hence need not be discussed here. As previously mentioned, the controls for the drum motor 20 and the jet printer 40 are described above in only a general way in that they are intended merely to typify any suitable control means that may be used to obtain the above described interrelation of operation of the printing drum 16 and the ink jet printer 40.

While the preferred embodiments of the invention have been disclosed in detail, it should be understood by those skilled in the art that various modifications may be made to the illustrated embodiments without departing from the scope thereof as described in the specification and defined in the appended claims.

We claim:

1. In a postage meter having a printing station and means for supporting at said printing station a document such as an envelope, label or the like that is to have postage indicia printed thereon, the improvement comprising:

an offset printing surface operably mounted in said meter;

a die plate carried by said offset printing surface including a first region formed with fixed information of the postage indicia such as the city and state and a second region for receiving thereon variable information of the postge indicia such as the date and postge amount;

means for applying ink to the fixed information on said first region;

an ink jet printing device that is adapted to project ink droplets onto said second region so as to form the variable information of the postage indicia;

said second region being movable between an operative position generally coplanar with said first region and an inoperative position depressed relative to said first region;

first means biasing said second region towards said inoperative position; and second means biasing said second region against the force of said first means towards said operative position during certain portions of the printing operation.

2. Apparatus as set forth in claim 1 wherein said offset printing surface is the outer peripheral surface of a drum rotatably mounted in said meter.

3. Apparatus as set forth in claim 2 including:

wiper means intermediate said ink jet printing device and said printing station having an outer surface movable between a first position distant from said second region and a second position engaged with said second region and effective to selectively erase the variable information applied thereto by said ink jet printing device before said die plate, upon rotation of said drum, reaches said printing station.

4. Apparatus as set forth in claim 3 including application means for applying an hydrophilic oil to the outer surface of said wiper means whereby the hydrophilic oil is transferred to said outer peripheral surface of said drum when said wiper means is in said second position.

5. Apparatus as set forth in claim 4 wherein the hydrophilic oil is selected from the group consisting of glycerine, glycol, polyethylene glycol, starch, hydroxy methyl cellulose and mixtures thereof.

6. In a postage meter having a printing station and means for supporting at said printing station a document such as an envelope, label or the like that is to have postage indicia printed thereon, the improvement comprising:

an offset printing surface operably mounted in said meter;

a die plate carried by said offset printing surface including a first region formed with fixed information of the postage indicia such as the city and state and a second region for receiving thereon variable information of the postage indicia such as the date and postage amount;

means for applying ink to said first region;

an ink jet printing device that is adapted to project ink droplets onto said second region so as to form the variable information of the postage indicia;

wiper means being actuatable to erase the variable information on said second region; and sensing means for detecting the quality of the variable information applied on said second region by said ink jet printing device before the postage indicia is printed on a document, said sensing means being operable to actuate said wiper means in the event the quality of the variable information is less than an acceptable level.

7. Apparatus as set forth in claim 6 wherein:

said second region is movable between an operative position generally coplanar with said first region and an inoperative position depressed relative to said first region;

said apparatus including:

first means biasing said second region towards said inoperative position; and second means biasing said second region against the force of said first means towards said operative position during certain portions of the printing operation.

8. Apparatus as set forth in claim 2 wherein:

said second region is radially movable between an operative position generally coplanar with said first region and an inoperative position depressed relative to said first region;

said apparatus including:

resilient means biasing said second region towards said inoperative position; and cam means biasing said second region against the force of said spring means towards said inoperative position during certain portions of the printing operation.

9. Apparatus as set forth in claim 8 including:

roller inking means for applying ink to said first region, said resilient means and said cam means being mutually cooperable during this portion of the printing operation to move said second region to said inoperative position.

10. Apparatus as set forth in claim 9 wherein said resilient means and said cam means are mutually cooperable during all other portions of the printing operation to move said second region to said operative position.

11. A postage meter as set forth in claim 1 including means on said postage meter for modifying the characteristics of the ink after it has been applied to at least one of said first region and said second region but before the document has been printed by said die plate.

12. A postage meter as set forth in claim 11 wherein the ink is of the type whose viscosity is reduced in response to application thereto of a catalyst, said modifying means being operable to apply the catalyst to the ink before the document has been printed by said die plate.

13. A postage meter as set forth in claim 11 wherein the ink is of the type whose viscosity is reduced in response to application thereto of electromagnetic radiation; said modifying means being a source of electromagnetic radiation directed toward the ink before the document has been printed by said die plate.

14. A postage meter as set forth in claim 11 wherein the ink is of the type whose viscosity is reduced in response to application thereto of heat; said modifying means being a heat transfer device for directing a heated medium toward the ink before the document has been printed by said die plate.

15. A method of printing which assures the accuracy of an image applied to a final viewing surface comprising the step of:

forming a visible ink image on an intermediate surface;

examining the image formed on the intermediate surface to determine its acceptability; and transferring the image from the intermediate surface to the final viewing surface only in the event the image is acceptable.

16. A method as set forth in claim 15 including the step of:

erasing the image formed on the intermediate surface in the event the image is determined to be unacceptable.

17. A method of printing postage indicia onto an object about to be mailed comprising the steps of:

forming a visible ink image of postage indicia on an intermediate surface;

examining the image formed on the intermediate surface to determine its acceptability;

transferring the image from the intermediate surface to the object about to be mailed only in the event the image is determined to be acceptable; and charging the account of the user responsible for applying the postage indicia onto the object about to be mailed in the event the image formed on the intermediate surface is determined to be acceptable.

18. A method of printing postage indicia as set forth in claim 17 including the steps of:

erasing the image formed on the intermediate surface in the event the image is determined to be unacceptable; and preventing occurrence of the step of debiting the account of the user responsible for applying the postage indicia onto the object about to be mailed.

19. Apparatus for printing so as to assure the accuracy of an image applied to a final viewing surface comprising:

means for forming a visible ink image on an intermediate surface;

sensing means for detecting the quality of the image formed on the intermediate surface and determining its acceptability;

intermediate printing means including said intermediate surface movable from a retracted image receiving position to an advanced position for transferring the image from the intermediate surface to the final viewing surface, said intermediate printing means being operable to move to said advanced position in response to a signal from said sensing means to the effect that the image formed is of acceptable quality.

20. Apparatus as set forth in claim 19 including:

wiper means intermediate said image forming means and the final viewing surface movable between a first position distant from said intermediate surface and a second position engaged with said intermediate surface and effective to erase the image formed thereon, said wiper means being operable to move from said first position to said second position in response to a signal from said sensing means to the effect that the image formed is not of acceptable quality.

21. Apparatus as set forth in claim 20 wherein said image forming means is an ink jet.

22. A postage meter having a printing station and means for supporting at said printing station a document such as an envelope, label or the like that is to have postage indicia printed thereon comprising:

an offset printing surface operably mounted in said meter and disposed to receive an image thereon;

means for forming a visible ink image on said offset printing surface;

means for moving said offset printing surface from a retracted position at which the image is formed thereon to an advanced position at which the image is transferred to the document at said printing station; and sensing means for detecting the quality of the image formed on said offset printing surface and determining its acceptability;

said offset printing surface moving means being operable to move to said advanced position in response to a signal from said sensing means to the effect that the image formed is of acceptable quality.

23. Apparatus as set forth in claim 22 including:

wiper means intermediate said image forming means and the printing station and movable between a first position distant from said offset printing surface and a second position engaged with said offset printing surface and effective to erase the image formed thereon, said wiper means being operable to move from said first position to said second position in response to a signal from said sensing means to the effect that the image formed is not of acceptable quality.

24. Apparatus as set forth in claim 23 wherein said image forming means is an ink jet.

25. Apparatus as set forth in claim 22 including accounting means for charging the account of the user of said apparatus in response to a signal from said sensing means to the effect that the image formed is of acceptable quality.

* * * * *